US005671847A

United States Patent [19]

Pedersen et al.

[11] Patent Number: 5,671,847

[45] Date of Patent: Sep. 30, 1997

[54] TRASH BAG DISPENSER

[76] Inventors: Constance Rebecca Pedersen; Sloane Kristin Pedersen; Knud Allen Pedersen, all of 16532 Cotuit Cir., Huntington Beach, Calif. 92649

[21] Appl. No.: 540,839

[22] Filed: Oct. 11, 1995

Related U.S. Application Data

[63] Continuation-in-part of Ser. No. 330,308, Oct. 27, 1994, abandoned.

[51] Int. Cl.[6] ..... B65D 1/34

[52] U.S. Cl. ..... 206/554; 206/390; 220/407

[58] Field of Search ..... 206/554, 494, 206/390, 410, 397; 220/407

[56] References Cited

U.S. PATENT DOCUMENTS

| | | | |
|---|---|---|---|
| 3,306,492 | 2/1967 | Kugler . | |
| 3,392,825 | 7/1968 | Gale et al. . | |
| 3,396,835 | 8/1968 | Boutonnet | 206/410 |
| 3,451,453 | 6/1969 | Heck . | |
| 3,800,503 | 4/1974 | Maki . | |
| 4,349,123 | 9/1982 | Yang . | |
| 4,420,080 | 12/1983 | Nakamura . | |
| 4,667,824 | 5/1987 | Ditchfield | 206/397 |
| 4,721,226 | 1/1988 | Yurko . | |
| 4,770,298 | 9/1988 | McFarland et al. | 206/390 |
| 4,805,800 | 2/1989 | Nocek et al. . | |
| 4,955,505 | 9/1990 | Battaglia . | |
| 5,000,340 | 3/1991 | Leggio . | |
| 5,031,793 | 7/1991 | Chen et al. . | |
| 5,115,935 | 5/1992 | Lemongelli . | |
| 5,183,157 | 2/1993 | Darden . | |
| 5,205,412 | 4/1993 | Krieg | 206/397 |
| 5,353,950 | 10/1994 | Taylor et al. . | |

*Primary Examiner*—Jacob K. Ackun
*Assistant Examiner*—Nhan T. Lam
*Attorney, Agent, or Firm*—Gifford, Krass, Groh, Sprinkle, Patmore, Anderson & Citkowski, P.C.

[57] ABSTRACT

A trash bag dispenser in the form of a pouch is disclosed. The pouch has an adhesive strip on the bottom for mounting to the interior of a trash container and an opening to provide access on the top to provide access to a continuous strip of trash can liners which are folded in an accordion like manner within the pouch. The pouch is thinly formed of a plastic film.

5 Claims, 2 Drawing Sheets

TRASH BAG DISPENSER

This is a Continuation-in-part of application Ser. No. 08/330,308 filed on Oct. 27, 1994, now abandoned.

BACKGROUND OF THE INVENTION

I. Field of the Invention

This invention relates to trash bag dispensers, and more particularly, to trash bag dispensers adapted to be mounted in the bottom of waste containers.

II. Description of the Prior Art

Plastic liners have been used for years to line the inside of trash containers or garbage cans. The liners are frequently packaged in boxes, or in rolls. The liner is removed from the box or roll and placed in the trash container to line its inside. After the liner is filled with trash, it is removed from the trash container and discarded and a new liner is removed from the package and inserted into the trash container. However, the packages of trash can liners are typically stored in a closet or the like and a new liner must be obtained from the package before insertion into the trash container.

Accordingly, it is known, as disclosed in Yurko, U.S. Pat. No. 4,721,226, to alter the waste container so that a dispenser box containing liners is inserted into the bottom of the trash container. The dispenser box contains a plurality of flatly folded bags which are retrievable from a slot in the top of the dispenser box. However, such a device requires a waste container specially modified to accept the dispenser box. Further, a portion of the interior space of the waste container is filled and lost to use because of space taken by the dispenser box.

It is also known to provide a device holding rolls of liners in the bottom of specially modified trash containers such as disclosed in U.S. Pat. No. 3,800,503 to Mackey, or U.S. Pat. No. 5,115,935 to Lemongelli require a specially adapted trash container.

It is also known, as disclosed in U.S. Pat. No. 5,000,340 to Leggio, to provide a rigid cylindrical dispensing apparatus mountable to the bottom of a trash container. The dispensing apparatus is adapted to dispense liners from a roll through a coaxially disposed slot. The cylindrical container is mounted to the bottom of the trash container by use of Velcro strips which are affixed to the bottom of the dispensing apparatus and to the trash container. However, such a device is bulky and results in the loss of some of the interior space of the trash container. Additionally, such a device is suited only for liners which are packaged in a continuous roll. Accordingly, it would be desirable to provide an economical dispenser which may be used in any type of trash container or trash compactor and minimizes the amount of interior space which is lost.

SUMMARY OF THE PRESENT INVENTION

The present invention relates to a novel dispenser for plastic liners used to line trash containers. The dispenser includes a thin rectangular pouch having an interior chamber formed between a top panel and a bottom panel portion. A plurality of liners are connected with perforations and folded in an accordion-like manner. The liners are disposed inside the pouch. The top panel has a cutout provided for removal of the liners from the pouch. An adhesive strip is mounted to the bottom portion so that the pouch may be adhered to a surface such as the interior of the trash container. In this manner, trash can liners may be dispensed from the pouch as it is mounted in the bottom of the trash container. The pouch is thin and lays flat beneath the trash can liners once the liners are positioned within the trash can for use. Accordingly, the pouch utilizes little of the volume of the trash container.

Further novel features of the present invention will become apparent from the following detailed description, discussion and appended claims taken in conjunction with the drawings.

BRIEF DESCRIPTION OF THE DRAWING

Referring particularly to the drawing for the purpose of illustration only and not limitation, there is illustrated.

DETAILED DESCRIPTION OF THE PREFERRED EMBODIMENT

Figure 1:
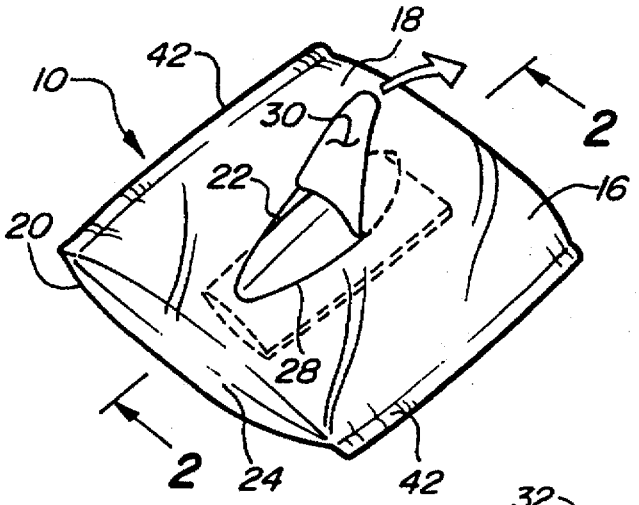
FIG. 1 is a perspective view of a dispenser for dispensing liners for a trash container in accordance with the invention.

Although a specific embodiment of the invention will be described with reference to the drawing, it should be understood that such an embodiment is by way of example only and merely illustrative of but one of a number of possible specific embodiments which can represent applications of the principals of the invention. Various changes and modifications obvious to one skilled in the art to which it pertains are deemed to be within the spirit, scope, and contemplation of the invention as further defined in the appended claims.

Figure 4:
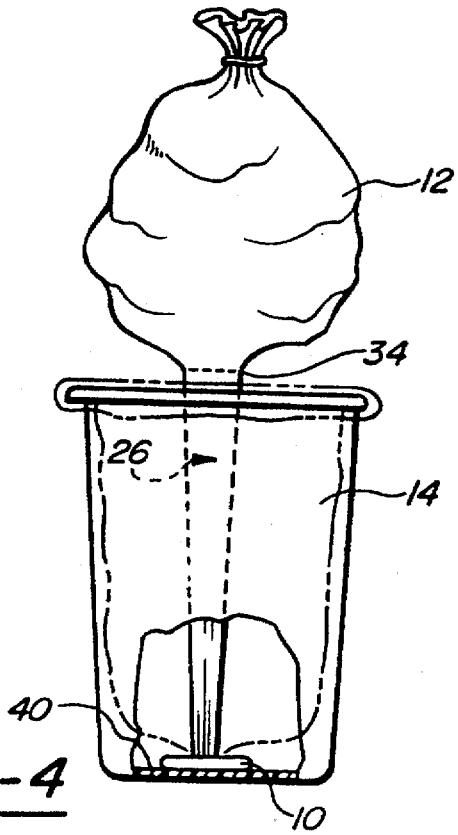
FIG. 4 is a side view partially in section, of a dispenser mounted in a trash container in position as it is being used for dispensing bags or liners.

Referring to FIGS. 1 and 4, there is shown a dispenser 10 for sequentially dispensing a plastic liner 12 for use in a trash container 14. The dispenser 10 may be used with any type or size of trash container, such as a plastic garbage can, trash compactor, or waste basket.

As shown in FIG. 1, the dispenser 10 includes a rectangular pouch 16 having a top panel 18 and a lower panel 20 extending between a pair of sides 24 to define an interior chamber 22. The pouch 16 may be formed of any suitable flexible material, such as plastic. Perforations are formed in the top panel to facilitate removal of a flap 30 to produce an oval shaped opening 28. The opening 28 is dimensioned to permit access to the liners in the chamber 22.

Figure 2:
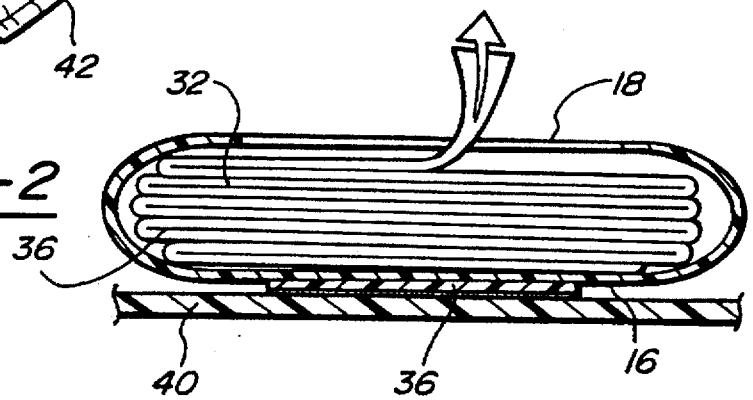
FIG. 2 is a cross-sectional view of the dispenser taken along lines 2—2 of FIG. 1.

As is shown in FIG. 2, a continuous strip 32 of liners is folded in an accordion style. The liners are connected end-to-end so that when a filled liner 12 is removed from the trash container, as shown in FIG. 4, a top 26 of the next liner is pulled up through the opening 28. A line of perforations 34 is provided to separate the liner 12 from the top 26 of the new liner. After separating, the new liner is available for positioning in the trash container 14.

Figure 3:
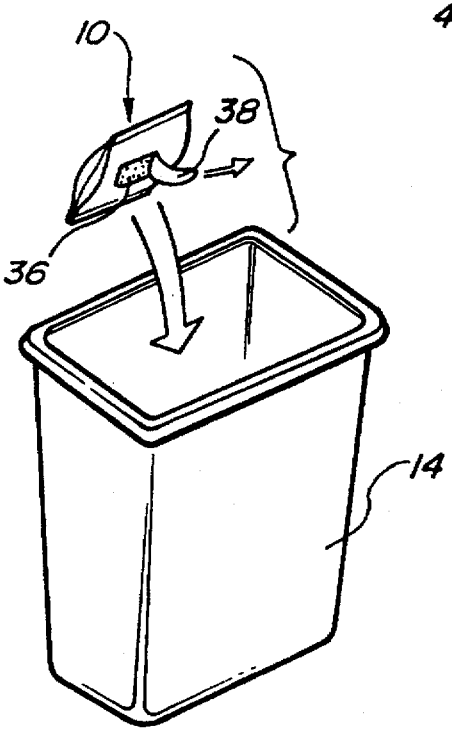
FIG. 3 is a perspective view of a dispenser in the process of being positioned in a trash can.

As shown in FIGS. 2 and 3, at least one attachment device, such as a double sided adhesive strip 36, is affixed to the exterior of the bottom panel 20. The adhesive strip 36 has an outer adhesive surface which is covered by a film strip 38 which is peeled from the strip 36 to permit the pouch 16 to be adhered to a bottom 40 of the trash container 14.

Alternatively, the pouch may be mounted in a convenient location outside of the trash container, such as an adjacent wall.

For marketing and shipping purposes, the flap 30 may be covered with a removable label (not shown) which is adhesively secured to the top panel 18 to cover the opening 28. When the time comes for use, the label is removed from the opening 28 and the film strip 38 is removed from the adhesive strip 36. The dispenser 10 then is positioned in the bottom of the trash container and pressed so that the adhesive strip 36 adheres to the bottom 40 of the trash container. In this manner, the dispenser 10 is securely mounted within the bottom 40 of the trash container 14 so that the liners may be removed sequentially from the pouch as needed and placed in the trash container, as shown in FIG. 4.

In the preferred embodiment, the pouch 16 is formed by taking a cylindrical sleeve of plastic material and inserting the strip 32 of liners snugly within the sleeve. Each end 42 of the sleeve is sealed by a suitable means, such as heat welding. Thus, a strip of approximately 15 liners may be housed in the pouch 10 having outer dimensions of approximately 4 inches×6 inches with a thickness of approximately 1 inch, thereby resulting in a compact dispenser having a thin profile. When mounted on the bottom of the trash container 14, the dispenser does not disturb the shape of the liner 12 disposed within the trash container 14 or reduce the volume of the liner.

Figure 5:
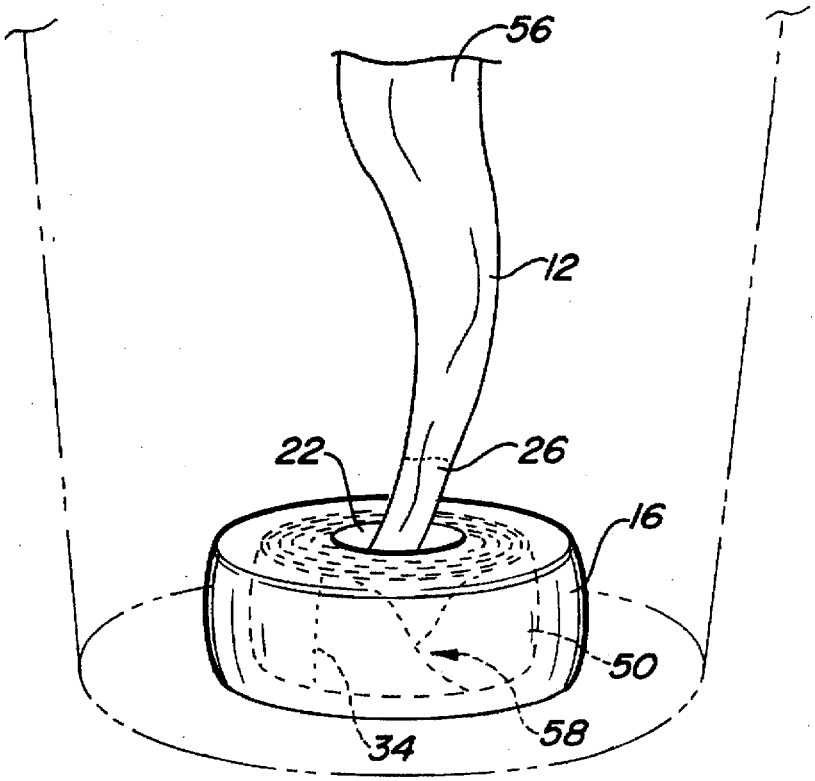
FIG. 5 is a perspective view of a first preferred embodiment of the invention.
Figure 6:
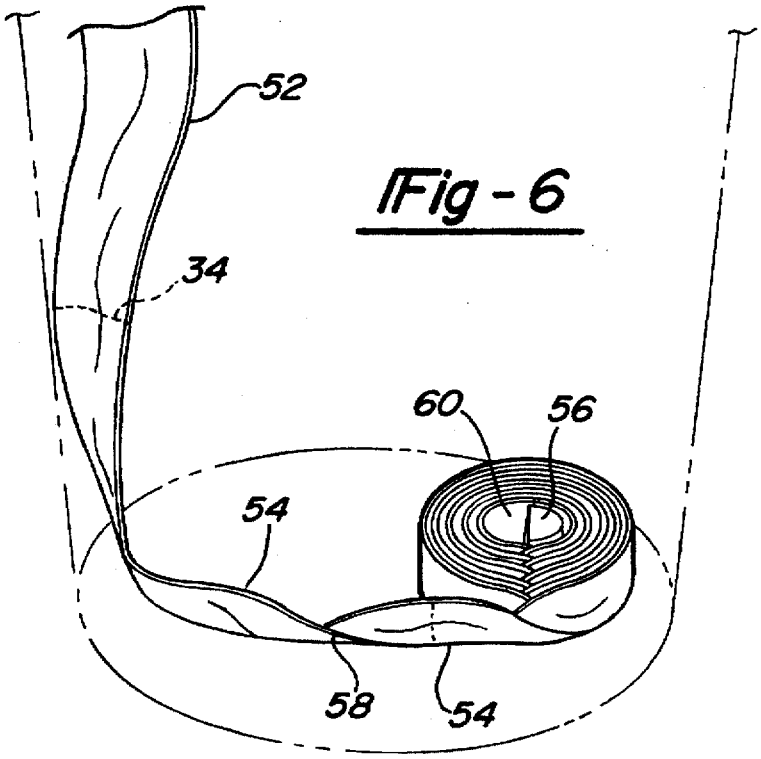
FIG. 6 is a perspective view of a spool of liners for use in the first preferred embodiment of the invention.

An alternative preferred embodiment of the invention is shown in FIGS. 5 and 6. In the preferred alternative embodiment, a coil 50 of plastic liners is advantageously utilized in the pouch 16. As shown in FIG. 6, the coil is formed by taking a continuous strip 52 of plastic liners and folding or pleating the strip into a band 54 approximately 2" in width. The band 54 is formed into the coil 50 by attaching one end 56 of the band 5 with the band aligned in the axial direction to a spindle and winding the band 54 around the spindle. A half twist 58 is formed in the band 54 as the band 54 is being wound for each revolution of the coil 50. During each revolution of the spindle, the liner is twisted 180° before the band is wound on the spool. The coil 50 is approximately 4" in diameter, formed with a central aperture 60 of approximately 1" in diameter. The coil 50 is inserted inside of the pouch 16 as set forth above. The inner end 56 of the coil 50 is then pulled up through the opening 28 of the pouch 16 as described previously and shown in FIG. 1. When the liners are removed from the pouch 16, the half twist facilitates removal of the liner from the inner diameter of the coil without disturbing the remainder of the coil remaining in the pouch. Liner perforations 34 are provided in the band of liners to facilitate separation of the liner from the top 26 of the new liner.

Although disclosed as a continuous strip, separate liners may be folded in an overlapping arrangement to pop up through the opening when one is removed. Likewise, the number of liners in the pouch may be larger or smaller than 15.

As discussed above, the invention provides an inexpensive and simply used dispenser for trash container liners which has a thin profile. The present invention is intended not to be restricted in any particular form or arrangement, or any specific embodiment disclosed herein. The embodiment disclosed herein is intended for illustration and for disclosure of an operative embodiment, not to show all the various forms or modifications which the invention might be embodied or operated.

We claim:

1. A dispenser for dispensing trash container liners, said dispenser comprising:

a flexible pouch having a top and a bottom defining a chamber, said top having an opening, said chamber housing a coil formed of a flat band of a plurality of trash container liners, said coil having an axis extending between said top and bottom of said chamber, said band having a half twist for each revolution of said coil and having an inner end of said coil removable through said opening of said pouch;

means for attaching said bottom surface of said pouch to a second surface.

2. The dispenser of claim 1, wherein said pouch is formed of a flexible material.

3. The dispenser of claim 1, wherein said plurality of liners is formed in a continuous strip.

4. The dispenser of claim 1, wherein said means for attaching comprises an adhesive strip.

5. The dispenser of claim 1, wherein said pouch comprises a tube having a pair of ends, each of said pair of ends being closed to form said chamber.

* * * * *